United States Patent [19]

Bunker, Jr.

[11] 4,222,021

[45] Sep. 9, 1980

[54] MAGNETIC APPARATUS APPEARING TO POSSESS ONLY A SINGLE POLE

[76] Inventor: Earle R. Bunker, Jr., 132 S. El Molino, Alhambra, Calif. 91801

[21] Appl. No.: 929,262

[22] Filed: Jul. 31, 1978

[51] Int. Cl.[2] ..... H01F 7/06

[52] U.S. Cl. ..... 335/296; 335/303

[58] Field of Search ..... 335/303, 302, 296

[56] References Cited

FOREIGN PATENT DOCUMENTS 961725 11/1960 United Kingdom ..... 335/303

*Primary Examiner*—Harold Broome

*Attorney, Agent, or Firm*—William W. Haefliger

[57] ABSTRACT

A magnetic device comprises magnetic segments that may be joined together to form a unitary body that appears to possess only a single pole.

1 Claim, 9 Drawing Figures

MAGNETIC APPARATUS APPEARING TO POSSESS ONLY A SINGLE POLE

BACKGROUND OF THE INVENTION

This invention relates generally to magnetic devices, and more particularly concerns magnetic segments that may be joined together to form a unitary body that appears to possess only a single pole.

It is commonly believed that each magnetized object has both a north pole and a south pole. While this appears to be true, no way was known, to my knowledge, to provide a unitary body possessing only unipolar characteristics to the external observor, so that the effects of the opposite pole were isolated.

SUMMARY OF THE INVENTION

It is a major object of the invention to provide a body appearing to have unipolar characteristics, and also to provide magnetic segments that may be assembled to form such a body. Accordingly, a major object of the invention is to provide:

(a) a magnetic segment having a north pole at one end and a south pole at its opposite end, said ends having generally polygonal outline, with the number of polygonal sides being a multiple of 3, (b) the segment having sides shaped to closely interfit the sides of like segments when the segments are assembled into a generally circular cross section form with the opposite ends of each segment spaced apart along a radius of said form.

As will appear, such segments may be assembled into generally spherical form with the opposite ends of each segment spaced apart along a spherical radius, thereby to provide an apparently unipolar, unitary body. Another example is a toroid.

Further objects include the provision of such segments which are alike with opposite ends having polygonal outline L hexagonal or triangular for example; and the provision of segments which consist of permanently magnetized material or material subject to magnetization, as for example iron adapted to serve as a solenoid. Also, a non-magnetic core may mount the segments.

These and other objects and advantages of the invention, as well as the details of an illustrative embodiment, will be more fully understood from the following description and drawings, in which:

DRAWING DESCRIPTION

FIG. 1 is a perspective view of a magnetic segment;

FIG . 2 is a generally spherical body incorporating segments as seen in FIG. 1;

FIG. 2*a* is a section through FIG. 2, on lines 2*a*—2*a* thereof;

DETAILED DESCRIPTION

Figure 1:
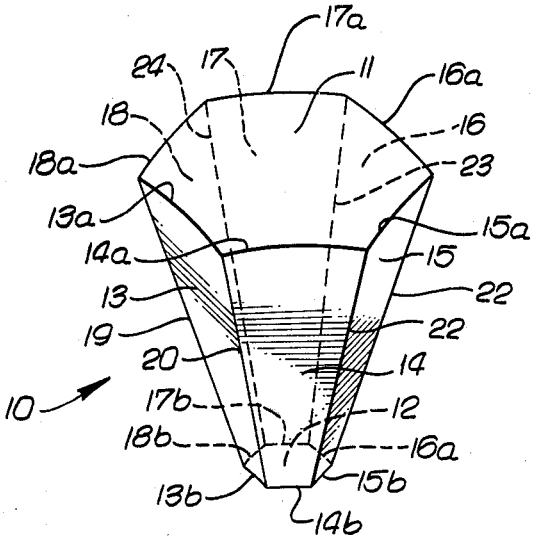

Referring first to FIG. 1, a magnetic segment 10 has opposite ends 11 and 12, and six flat sides 13–18. The intersections of the sides with the ends are indicated by the lines 13*a*–18*a* and 13*b*–18*b*. The intersections of the sides are indicated by the lines 19–24. Each of the sides 13–18 is like all the others, and the linear intersections 13*a*–18*a* form a hexagon, as do the linear intersections 13*b*–18*b*.

The segment 10 consists of permanently magnetized material, such as ALNICO, for example. Accordingly, the ends 11 and 12 define north and south poles, or vice versa. Ends 11 are larger than ends 12.

Figure 2:
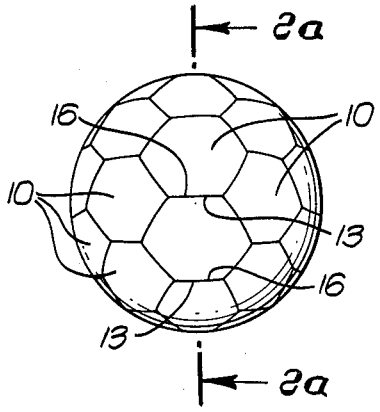
Figure 2A:
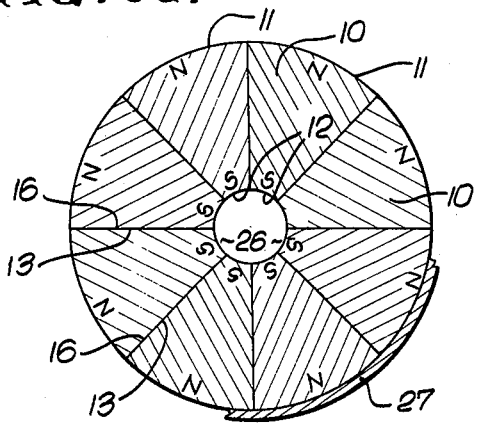

It will be seen that the segment sides are shaped to closely interfit one another when assembled into a generally spherical unitary body form as in FIG. 2, with the opposite ends 11 and 12 of each segment spaced along a spherical radius. See also FIG. 2*a*, where ends 11 define north poles and ends 12 define south poles, for example. The enclosed hollow at the center of the apparatus is designated at 26. The sides of the segments may be bonded together so as to very closely interfit.

Alternatively, external holder means 27 may be wrapped about the apparatus to hold the segments in position, with their sides in very closely engaged position. All sides 13–18 of each segment are engaged by like sides of other segments; so that central hollow 26 is completely enclosed. Accordingly, from the exterior, the apparatus appears as a unipolar device, i.e. it appears as a north pole, (or alternatively a south pole if ends 11 have south pole magnetization).

Figure 3:
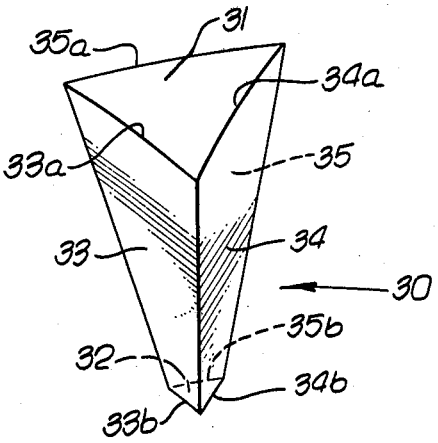
FIG. 3 is a view like FIG. 1, showing a modified magnetic segment.

In FIG. 3, the modified magnetic segment 30 has opposite ends 31 and 32, and three like sides 33–35. The latter intersect the ends at lines 33*a*–35*a* and 33*b*–35*b*. Lines 33*a*–35*a* form an equilateral triangle, and lines 33*b*–35*b* also form an equilateral triangle. Six of the segments 30 may be interconnected to form one of the segments 10, i.e. so that the six ends 31 form end 11, and the six ends 32 form end 12.

Figure 4:
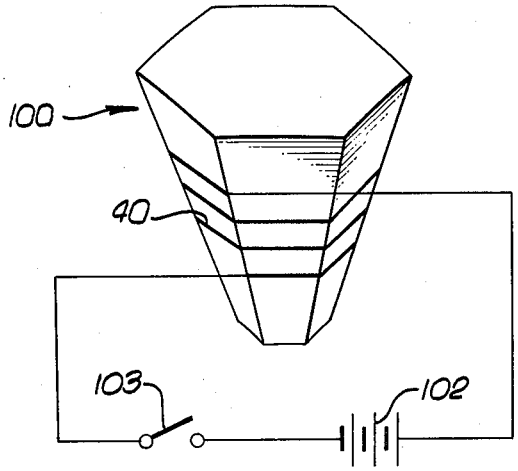
FIG. 4 is a view like FIG. 3, showing yet another modified segment.
Figure 4A:
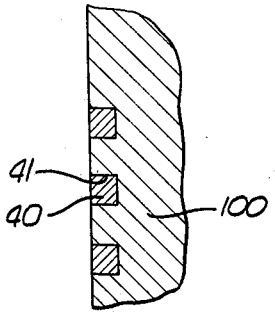
FIG. 4*a* is a section of a part of FIG. 4.

In FIG. 4, the magnetic segment 100 is exactly like that in FIG. 1; however, it is not a permanent magnet, but rather an induced magnetic segment. It may be defined by a solenoid that includes the segment plus coil 40 about the segment as in FIG. 4*a*. As there shown, the square cross-section wire 40 exactly fits the square cross section groove 41 in the segment material 100. A source of electrical current, such as battery 102 is connected with coil 40, via switch 103, to effect magnetization of the segment.

Figure 5:
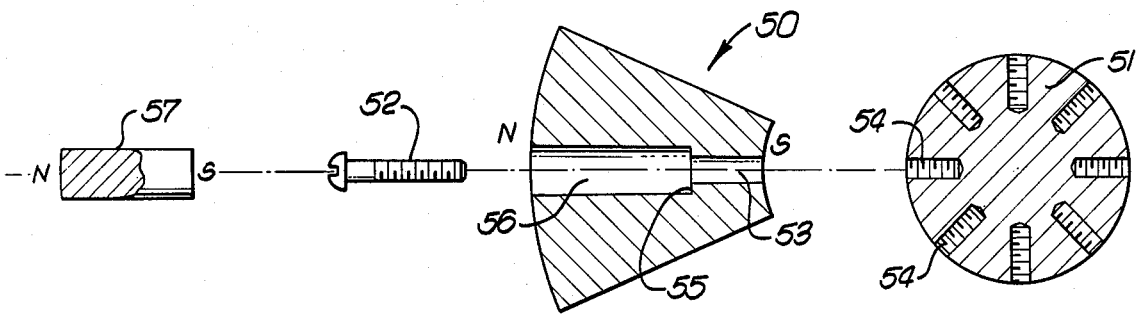
FIG. 5 is an exploded view showing a modification.

In FIG. 5, the segments, as at 50, are attached to a non-magnetic core 51 of spherical outline form. For example, the core may consist of plastic, or aluminum, these being examples only. A holding screw 52 fits in a radial bore 53 in the segment, the latter having a peripheral outline like that of segments seen in FIG. 1 or 3. The screw thread attaches to a threaded bore 54 in the core, and the screw head seats against shoulder 55 at the inner end of a larger radial bore 56 in the segment. A plug magnet 57 finally fits into the bore 56 to fill it. The plug magnet may be bonded to bore 56. All segments fit side by side as in FIG. 2.

Figure 6:
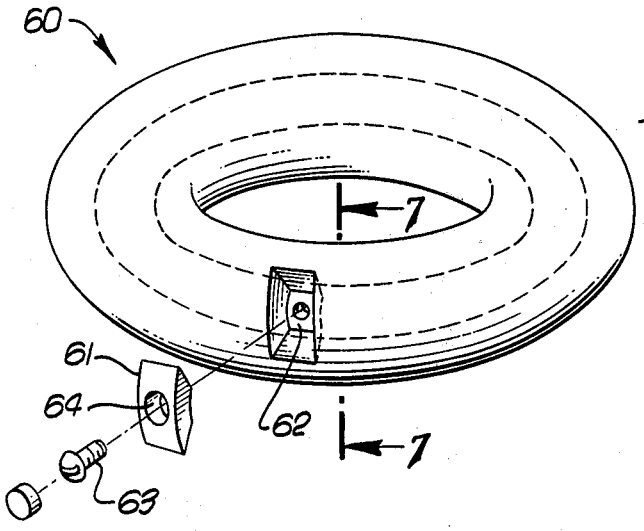
FIG. 6 is an elevation showing a toroidal form.
Figure 7:
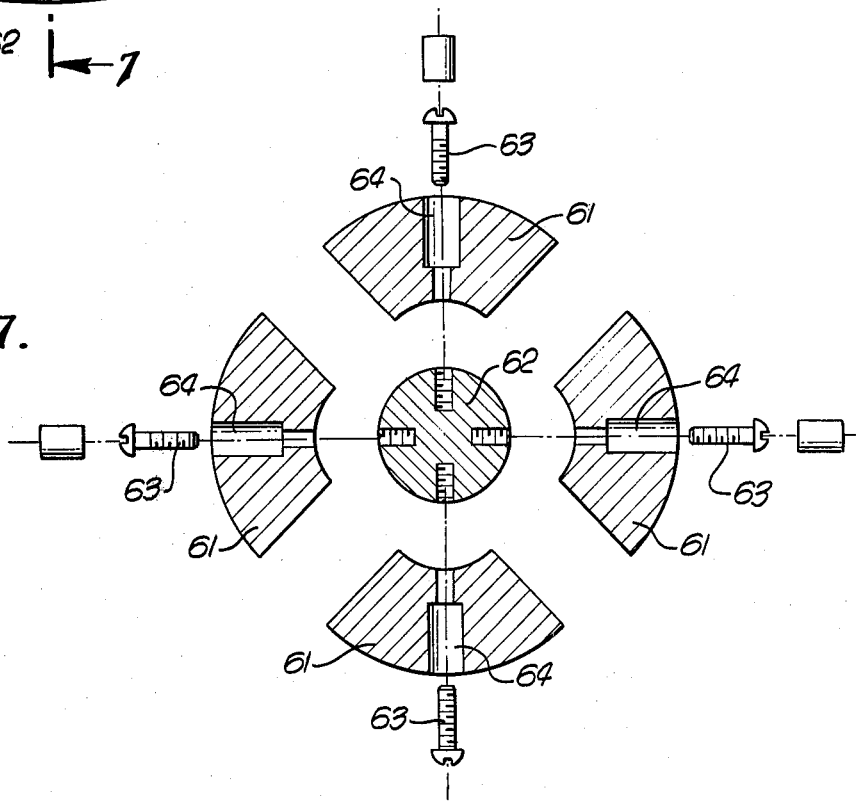
FIG. 7 is an exploded view of a section on lines 7—7 of FIG. 6.

In FIGS. 6 and 7 an externally unipolar toroid 60 includes magnetic segments 61 attached to an annular non-metallic core 62, so that either the north or the south pole ends of all segments are presented outwardly, as seen in FIG. 7. Four segments, for example, may be spaced about the core in a cross section as in FIG. 7. Screws 63 are received in bores 64 in the segments, and attach them to the core, as in FIG. 5. All segments fit side-by-side, so that the surface of the FIG. 6 toroid appears unipolar.

I claim:

1. In apparatus of the character described, (a) a plurality of like magnetic segments each having a north pole at one end and a south pole at the opposite end, said ends each having generally polygonal edge outline with the total number of edges being a multiple of 3, one end of each segment being larger in area than the opposite end thereof, (b) said segments having sides shaped to closely interfit one another when assembled into a generally circular cross section form with the opposite ends of each segment spaced apart along a radius of said circular cross section form, (c) a central non-magnetic core to which said opposite ends are connected, (d) and wires wrapped about each of the segments to define solenoids therewith, there being recesses sunk in the sides of each segment to receive said wires.

* * * * *